US006250503B1

(12) United States Patent
Dark

(10) Patent No.: US 6,250,503 B1
(45) Date of Patent: Jun. 26, 2001

(54) FLUID DISPENSING VALVE AND METHOD OF USE

(76) Inventor: Richard C. G. Dark, 2248 Gum Tree La., Fallbrook, CA (US) 92028

( * ) Notice: Subject to any disclaimer, the term of this patent is extended or adjusted under 35 U.S.C. 154(b) by 0 days.

(21) Appl. No.: 09/619,892

(22) Filed: Jul. 19, 2000

(51) Int. Cl.[7] ..... B65G 59/00; B06F 11/00; B65D 25/40; B65D 35/38; B65D 5/72

(52) U.S. Cl. ..... 222/1; 222/494

(58) Field of Search ..... 222/1, 212, 113, 222/494, 563, 335, 491, 495, 481.5, 481, 482; 137/493, 493.9; 251/61.1

(56) References Cited

U.S. PATENT DOCUMENTS

| | | |
|---|---|---|
| 4,728,006 | 3/1988 | Drobish et al. . |
| 5,005,737 | 4/1991 | Rohr . |
| 5,169,035 | 12/1992 | Imbery, Jr. . |
| 5,271,531 | 12/1993 | Rohr et al. . |
| 5,971,232 * | 10/1999 | Rohr et al. ..... 222/494 |

* cited by examiner

*Primary Examiner*—Kevin Shaver
*Assistant Examiner*—Stephanie L. Willatt
(74) *Attorney, Agent, or Firm*—Eric Karich

(57) ABSTRACT

A dispensing closure for controlling the flow of a fluid from a container has a conduit having an interior conduit surface partially blocked by a top retainer and a bottom retainer. The dispensing closure further includes a fluid dispensing valve that includes a resilient dome area and a seal area. The seal area extends outwardly, and preferably downwardly, from the dome perimeter to define a seal perimeter shaped to conform to the interior conduit surface to form a seal when the fluid dispensing valve is operably positioned within the conduit between the top and bottom retainers. At least one rib fixedly connects the seal area to the dome area such that deformation of the dome area is transmitted through the at least one rib to the seal area to disrupt the seal and form at least one dispensing flow path. Air pressure on an exterior seal surface of the seal area causes the seal area to deform between the at least one rib to form at least one venting flow path.

13 Claims, 2 Drawing Sheets

FLUID DISPENSING VALVE AND METHOD OF USE

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates generally to fluid dispensing valves, and more particularly to a dispensing closure having a fluid dispensing valve that functions to dispense fluid when a container bearing the dispensing closure is squeezed or when the dispensing closure is sucked upon and yet will not leak when the container is turned upside down or bumped.

2. Description of Related Art

Various automatic closing dispensing closures have been designed to fit on the container for dispensing beverages, liquids, soaps and other fluent materials that one might purchase at the supermarket. The closures may also be used on a baby drinking cup or cyclist water bottle whereupon the beverage would be dispensed by sucking on the closure or by squeezing the container.

Prior art closures primarily utilize a silicone dome dispensing system whereby the dome is penetrated by a pair of slits. The slits on the prior art domed surfaces open like petals when sufficient force is pushed upon it by the difference in the pressure in the container as compared to the pressure outside the container. Examples of these constructions are taught in Drobish et al., U.S. Pat. Nos. 4,728,006 and Rohr, 5,005,737 and 5,271,531.

There are several important disadvantages to the prior art construction. First, the slits used in the prior art are not effective in preventing accidental leakage if the container is bumped or dropped. Second, the slits must be added after the rubber dome is molded and therefore require a second operation, which adds to the cost of manufacturing the product.

Another prior art dispensing closure is shown in Imbery, Jr., U.S. Pat. No. 5,169,035. The Imbery, Jr. valve is excellent at venting air back into the container without allowing leakage through the venting flow path; however, the Imbery, Jr. closure does not teach a mechanism to control the outward flow of the fluid through the primary conduit.

In order to be effective, the fluid dispensing valve must meet three conditions. First, the valve should not dispense if the container is bumped or accidentally squeezed slightly. Second, the valve should vent and allow air to pass back through it into the container to make up the volume it has dispensed. Third, the valve must be inexpensive to manufacture.

The prior art teaches various valves used to regulate the flow of fluid into and out of a container. However, the prior art does not teach a valve that meets all three requirements of an effective fluid dispensing valve. The present invention fulfills these needs and provides further related advantages as described in the following summary.

SUMMARY OF THE INVENTION

The present invention teaches certain benefits in construction and use which give rise to the objectives described below.

The present invention provides a fluid dispensing valve in a dispensing closure for controlling the flow of a fluid from a container bearing the dispensing closure. The dispensing closure includes a conduit having an interior conduit surface partially blocked by a top retainer and a bottom retainer. The fluid dispensing valve includes a resilient dome area and a seal area. The seal area extends outwardly, and preferably downwardly, from the dome perimeter to define a seal perimeter shaped to conform to the interior conduit surface to form a seal when the fluid dispensing valve is operably positioned within the conduit between the top and bottom retainers. At least one rib fixedly connects the seal area to the dome area such that deformation of the dome area is transmitted through the at least one rib to the seal area to disrupt the seal and form at least one dispensing flow path. Air pressure on an exterior seal surface of the seal area causes the seal area to deform between the at least one rib to form at least one venting flow path. In use, the dispensing closure containing the fluid dispensing valve functions to dispense fluid when the container bearing the dispensing closure is squeezed or when the dispensing closure is sucked upon and yet will not leak when the container is turned upside down or bumped.

A primary objective of the present invention is to provide a fluid dispensing valve having advantages not taught by the prior art.

Another objective is to provide a fluid dispensing valve that does not leak in response to minor or momentary forces such as bumps and spills, but easily and freely dispenses fluid in response to sustained forces such as squeezing a container incorporating the fluid dispensing valve.

A further objective is to provide a fluid dispensing valve that allows air to vent back into the container once the fluid has been dispensed.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a fluid dispensing valve 20 for controlling the flow of a fluid through a dispensing closure 40 mounted upon a container 10.

Figure 1:
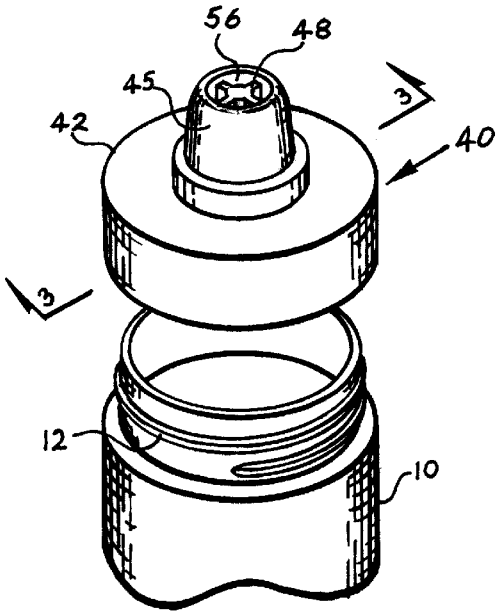
FIG. 1 is a perspective view of the preferred embodiment of the present invention.
Figure 3:
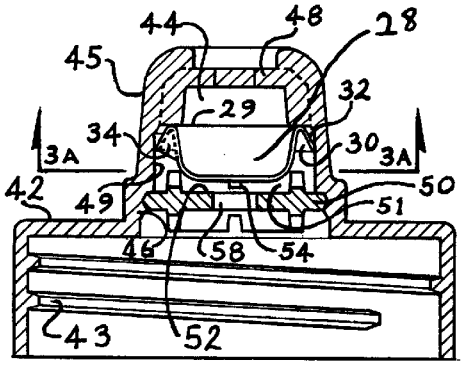
FIG. 3 is a sectional view taken along line 3—3 in FIG. 1 of a dispensing closure showing the fluid dispensing valve in a static position.

As shown in FIGS. 1 and 3, the dispensing closure 40 preferably includes a closure body 42, a top retainer 48, and a bottom retainer 50. The closure body 42 includes a conduit 44 having an interior conduit surface 49. The dispensing closure 40 preferably includes a spout 45 and an internal thread 43, the internal thread 43 allowing the dispensing closure 40 to threadedly engage a threaded opening 12 of the container 10 to seal the container 10. The closure body 42 is preferably a rigid molded plastic cap constructed of a polyolefin such as polypropylene or polyethylene. The container 10 is preferably a flexible, resilient plastic bottle commonly known as a sports bottle, or a similar beverage bottle, shampoo bottle, or the like.

Figure 2A:
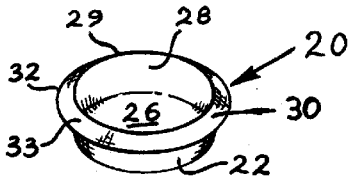
FIG. 2A is a top perspective view of a fluid dispensing valve.
Figure 2B:
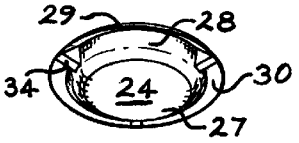
FIG. 2B is a bottom perspective view thereof.

As shown in FIGS. 2A and 2B, the fluid dispensing valve 20 includes a resilient dome area 22 and a seal area 30. The resilient dome area 22 has an interior dome surface 24, an exterior dome surface 26, and a dome perimeter 29. The exterior dome surface 26 is preferably roughly concave and the interior dome surface 24 is preferably a matching convex, forming a roughly dome shaped structure. In the most preferred embodiment, the resilient dome area 22 includes a base area 27 and an upwardly extending sidewall 28, the base area 27 being generally flat but cooperating with the upwardly extending sidewall 28 to form the dome area. While the dome shape is the most effective, equivalent shapes should be considered within the scope of the invention as claimed.

The seal area 30 extends outwardly, and preferably downwardly, from the dome perimeter 29 to define a seal perimeter 32. The seal perimeter 32 is shaped to conform to the interior conduit surface 49, as described below. The seal area 30 includes an exterior seal surface 33 whose function in venting the container 10 is described in more detail below. The fluid dispensing valve 20 is preferably constructed of a resilient rubber, such as natural rubber, silicon rubber, or thermoplastic rubber, that can be deformed under a specific amount of pressure to form at least one dispensing flow path 60 to dispense the fluid from the container 10, and at least one venting flow path 62 to allow air to vent into the container 10 once the fluid has been dispensed. The formation of the at least one dispensing and venting paths 60 and 62 is described in detail below.

As shown in FIG. 2B, the fluid dispensing valve 20 further includes at least one rib 34 fixedly connecting the seal area 30 to the dome area such that deformation of the resilient dome area 22 is transmitted through the at least one rib 34 to the seal area 30. In the preferred embodiment, the at least one rib 34 includes three ribs equally spaced around the dome perimeter 29. As described in greater detail below, it is critical that the resilient dome area 22 transmit its deformation to the seal area 30, under the proper circumstances, such that the seal area 30 is no longer shaped to conform to the interior conduit surface 49, thus allowing the fluid to flow through the conduit 44.

As shown in FIG. 3, the conduit 44 of the dispensing closure 40 includes a bottom retainer 50 and a top retainer 48. The fluid dispensing valve 20 is operably positioned between the top and bottom retainers 48 and 50 such that the interior dome surface 24 is adjacent the bottom retainer 50, the dome perimeter 29 is adjacent the top retainer 48, and the seal perimeter 32 contacts the interior conduit surface 49 to seal the conduit 44. The bottom retainer 50 defines a bottom aperture 58 shaped to direct the fluid from the container 10 onto the interior dome surface 24. The top retainer 48 defines a top aperture 56 shaped to allow the fluid to exit the conduit 44.

The top retainer 48 and the top aperture 56 are preferably formed by several ribs integrally molded with the closure body 42 to create several dispensing flow passages. The specific structure of the top retainer 48 and the top aperture 56 is not critical, and can be modified by those skilled in the art, as long as the top retainer 48 functions to hold the fluid dispensing valve 20 in position and the top aperture 56 allows proper flow of the fluid.

The bottom retainer 50 is preferably a plastic disk and the bottom aperture 58 is preferably at least one hole in its center, although multiple holes are acceptable. The bottom retainer 50 is preferably attached to the closure body 42 by frictionally engaging the bottom retainer 50 with a locking lip 46 of the closure body 42. The bottom aperture 58 allows the fluid being dispensed to pass through the bottom retainer 50 and come in contact with the fluid dispensing valve 20, preferably first contacting the exterior dome surface 26. The bottom retainer 50 is preferably a disk having a support ring 51 that is upwardly extending from and co-axially aligned with a top surface 52 of the disk. The support ring 51 preferably includes a plurality of notches 54. The support ring 51 is shaped to support the interior dome surface 24 of the fluid dispensing valve 20. The support ring 51 preferably includes the plurality of notches 54 to facilitate airflow around the resilient dome area 22, as described in greater detail below.

Figure 3A:
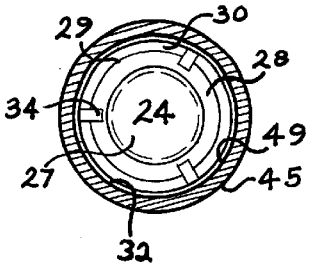
FIG. 3A is a sectional view thereof taken along line 3A—3A in FIG. 3.

When the fluid dispensing valve 20 is in a static position, as shown in FIGS. 3 and 3A, the seal perimeter 32 is in contact with the interior conduit surface 49 blocking the flow of the fluid through the conduit 44 of the closure body 42. If the container 10 is turned upside down, the fluid flows through the bottom aperture 58 but is unable to pass beyond the fluid dispensing valve 20. It is critical that the fluid dispensing valve 20 be constructed of a material that is rigid enough to maintain the seal under these conditions.

Figure 4:
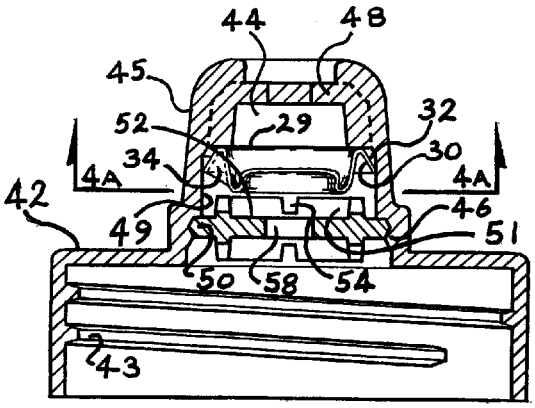
FIG. 4 is a sectional view taken along line 3—3 in FIG. 1 of a dispensing closure showing the fluid dispensing valve moving out of the static position in response to a momentary force, the fluid dispensing valve still functioning to seal the conduit.
Figure 4A:
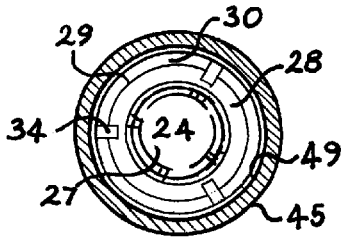
FIG. 4A is a sectional view thereof taken along line 4A—4A in FIG. 4.

As shown in FIGS. 4 and 4A, if the container 10 is knocked over, bumped, or partially squeezed, the fluid is not immediately dispensed. The resilient dome area 22 initially collapses, absorbing the first portion of the fluid without dispensing. The interior dome surface 24 is approximately 67% of the total inside surface area of the fluid dispensing valve 20, while the seal area 30 is only approximately 33% of the total inside surface area. Initial pressure brought to bear on the interior dome surface 24 presses the seal perimeter 32 harder against the interior conduit surface 49 while depressing the resilient dome area 22.

Figure 5:
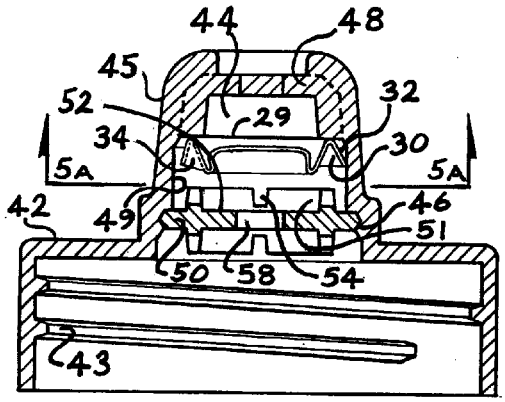
FIG. 5 is a sectional view taken along line 3—3 in FIG. 1 of a dispensing closure showing the fluid dispensing valve in a dispensing position.
Figure 5A:
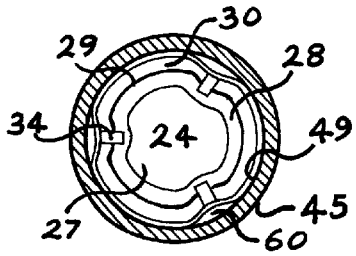
FIG. 5A is a sectional view thereof taken along line 5A—5A in FIG. 5.

As shown in FIGS. 5 and 5A, as the fluid continues to increase its pressure against the fluid dispensing valve 20, the resilient dome area 22 continues to invert, whereby at a predetermined pressure, the resilient dome area 22 will begin to pull on the at lest one rib 34, thereby deforming the seal area 30 and creating at least one dispensing flow path 60 where the seal perimeter 32 is pulled away from the interior conduit surface 49. Only at this point can the fluid flow through the conduit 44 of the closure body 42. Those skilled in the art can fine-tune the shape, thickness, and material of the fluid dispensing valve 20 such that it releases the fluid at the proper point. Ideally, the fluid dispensing valve 20 allows the fluid to pass only when the container 10 is squeezed or when a user sucks on the spout 45, not when the container 10 falls over or is otherwise inverted.

Once the fluid has been dispensed, the plurality of dispensing flow paths 60 close, but it becomes necessary to replace the fluid that has been dispensed so that the container 10 can return to its original shape. For the container 10 to fully return to its original shape, air must pass back into the container 10 past the fluid dispensing valve 20 to make up for the volume dispensed.

Figure 6:
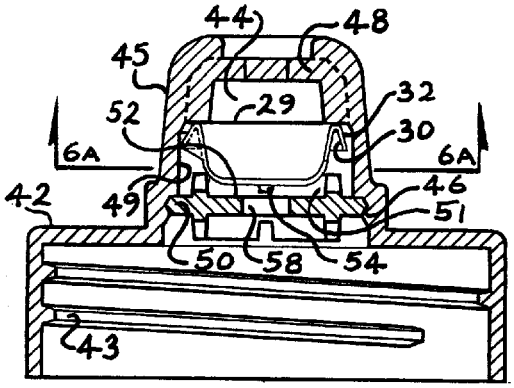
FIG. 6 is a sectional view taken along line 3—3 in FIG. 1 of a dispensing closure showing the fluid dispensing valve in a venting position.
Figure 6A:
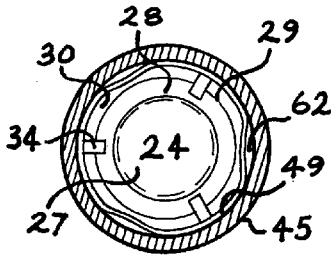
FIG. 6A is a sectional view thereof taken along line 6A—6A in FIG. 6.

As shown in FIGS. 6 and 6A, once the fluid has been dispensed, atmospheric pressure on the exterior seal surface 33 of the seal area 30 causes the seal area 30 to collapse adjacent to the at least one rib 34 to create at least one venting flow path 62. The at least one venting flow path 62 is formed where portions of the seal perimeter 32 lose contact with the interior conduit surface 49 and allow air to enter the container 10. To facilitate the airflow through the at least one venting flow path 62, the fluid dispensing valve 20 is preferably supported by the support ring 51 of the bottom retainer 50 such that the plurality of notches 54 through the support ring 51 allow unobstructed airflow past the bottom retainer 50. In the preferred embodiment, the bottom retainer 50 has a support ring 51 on either side, thereby facilitating assembly because the bottom retainer 50 is symmetrical and cannot accidentally be put in upside down.

It is preferred that the resilient dome area 22 has significantly greater surface area than the seal area 30 so that as the internal pressure increases on the resilient dome area 22, the seal area 30 remains firmly positioned against the interior conduit surface 49 until significant pressure is placed on the resilient dome area 22 and it inverts. Because the resilient dome area 22 is larger in area than the seal area 30, it can exert significant pull on the at least one rib 34 and overcome the pressure biasing the seal perimeter 32 against the interior conduit surface 49.

To allow greater impacts upon the container 10 without allowing spillage of the fluid, the size of the resilient dome area 22 is increased to allow for more deflection in the container 10 when the container 10 is accidentally depressed or dropped. The resilient dome area 22 can be a higher or lower percentage of the seal area 30 as long as the resilient dome area 22 exceeds the total surface area of the seal area 30. If the resilient dome area 22 has a smaller diameter, greater pressure is required to open the fluid dispensing valve 20. The fluid dispensing valve 20 may also have a greater or lesser number of the at least one rib 34, with more ribs serving to increase the number of the plurality of dispensing flow paths 60 around the fluid dispensing valve 20, whereas too many ribs may impede the function of the fluid dispensing valve 20.

The invention includes a method of dispensing fluid from the container 10 through the dispensing closure 40 described above. The fluid dispensing valve 20 is operably positioned in the conduit 44, as described above, such that the dome perimeter 29 contacts the top retainer 48. The bottom retainer 50 is then snapped into place, frictionally engaging the locking lip 46, to lock the fluid dispensing valve 20 into place. The dispensing closure 40 is then mounted onto the container 10 over the threaded opening 12 such that the conduit 44 communicates with the threaded opening 12 of the container 10. In the preferred embodiment, the dispensing closure 40 threadedly engages the container 10, as described above; however, those skilled in the art can obviously devise many attachment mechanisms that would serve the required function.

In use, the container 10 is filled with the fluid that is to be dispensed, such as water, a flavored drink, shampoo, or other fluid. As assembled, the container 10 can be inverted without spilling the fluid. When the container 10 is inverted, the fluid passes through the bottom aperture 58 to contact the interior dome surface 24, but the fluid dispensing valve 20 does not allow the fluid to pass. Minor impacts upon the container 10, such as might otherwise cause the fluid dispensing valve 20 to leak, merely cause the resilient dome area 22 to partially collapse, as shown in FIGS. 4 and 4A, but not to disrupt the seal.

To activate the fluid dispensing valve 20, there must be a different pressure between the contents in the container 10 and the pressure outside the closure body 42. In other words, if the closure body 42 is sucked, the pressure outside the closure body 42 is lower than the pressure in the container 10 and the fluid will pass through the conduit 44 of the closure body 42. This also applies if the container 10 is squeezed. When the user squeezes the container 10, however, the shrinking volume of the container 10 increases the pressure of the fluid against the resilient dome area 22 for an extended time. Rather than merely causing a temporary collapse of the resilient dome area 22, the sustained pressure causes the dome area to deform and, through the at least one rib 34, interrupt the sealed relationship of the seal perimeter 32 with the conduit 44. The deformation of the seal area 30 forms the plurality of dispensing flow paths 60 shown in FIGS. 5 and 5A and as described above, thus allowing the fluid to flow through the conduit 44 and out of the container 10.

Once the fluid has been dispensed, the resilience of the container 10 creates a partial vacuum within the container 10, and it is desirable that the fluid dispensing valve 20 allow air to flow back into the container 10. As described above, the pressure on the seal area 30 causes the portions of the seal area 30 that are not supported by the at least one rib 34 to flex inwards, thereby creating the plurality of venting flow paths 62 shown in FIGS. 6 and 6A.

It is important to recognize that the above description relates to the currently preferred embodiment of the fluid dispensing valve 20. The fluid dispensing valve 20 can readily be adapted to different closure bodies for use with different containers or systems. The fluid dispensing valve 20 will function to regulate the flow of any fluids, either gaseous or liquid, either from a container 10 or within a larger system, as long as the pressures of the fluids with various viscosities can be manipulated with respect to each other. Those skilled in the art can readily adapt the fluid dispensing valve 20 to different uses, and these alternative uses should be considered within the scope of the invention, as claimed.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fluid dispensing valve for controlling the flow of a fluid through a conduit having a top retainer, a bottom retainer, and an interior conduit surface, the fluid dispensing valve comprising:

a resilient dome area having an interior dome surface, an exterior dome surface, and a dome perimeter, the exterior dome surface being concave;

a seal area extending outwardly from the dome perimeter to define a seal perimeter, the seal perimeter being shaped to conform to the interior conduit surface and seal the conduit when the fluid dispensing valve is operably positioned between the top and bottom retainers; and at least one rib fixedly connecting the seal area to the dome area such that deformation of the dome area is transmitted through the at least one rib to the seal area, thereby deforming the shape of the seal area such that the seal area is no longer shaped to conform to the interior conduit surface.

2. The fluid dispensing valve of claim 1 wherein the seal area extending outwardly and downwardly from the dome perimeter such that fluid pressure on an exterior seal surface of the seal area causes the seal area to collapse between the at least one rib to create at least one venting flow path.

3. The fluid dispensing valve of claim 1 wherein the at least one rib includes three ribs equally spaced around the dome perimeter.

4. A dispensing closure for an opening defined by a container to control the flow of a fluid from the container, the dispensing closure comprising:

a closure body for mounting onto the container over the opening, the closure body defining a conduit for communicating with the container opening, the conduit having a bottom retainer, a top retainer, and an interior conduit surface;

a fluid dispensing valve having a resilient dome area and a seal area, the resilient dome area having an interior dome surface, an exterior dome surface, and a dome perimeter;

the fluid dispensing valve being operably positioned between the top and bottom retainers, the bottom retainer defining a bottom aperture shaped to direct the fluid from the container onto the interior dome surface, the top retainer defining a top aperture shaped to allow the fluid to exit the conduit;

the seal area extending outwardly from the dome perimeter to define a seal perimeter, the seal perimeter being shaped to conform to the interior conduit surface and seal the conduit when the fluid dispensing valve; and at least one rib fixedly connecting the seal area to the dome area such that, when the pressure exerted by the fluid against the interior conduit surface is great enough to overcome the pressure against the exterior conduit surface and deform the dome area, the deformation is transmitted through the at least one rib to the seal area, thereby deforming the shape of the seal area such that the seal area is no longer shaped to conform to the interior conduit surface.

5. The dispensing closure of claim 4 wherein the seal area extending outwardly and downwardly from the dome perimeter such that fluid pressure on an exterior seal surface of the seal area causes the seal area to collapse between the at least one rib to create at least one venting flow path.

6. The dispensing closure of claim 4 wherein the at least one rib includes three ribs equally spaced around the dome perimeter.

7. The dispensing closure of claim 4 wherein the bottom retainer is a disk having a support ring that is upwardly extending from and co-axially aligned with a top surface of the disk, the support ring having a plurality of notches.

8. A method of dispensing a fluid, the method comprising the steps of:

providing a container having an opening;

providing a dispensing closure having a closure body, the closure body defining a conduit, the conduit having a bottom retainer, a top retainer, and an interior conduit surface, the bottom retainer defining a bottom aperture and the top aperture defining a bottom aperture;

providing a fluid dispensing valve having a resilient dome area and a seal area, the resilient dome area having an interior dome surface, an exterior dome surface, and a dome perimeter, the seal area extending outwardly from the dome perimeter to define a seal perimeter, the fluid dispensing valve further having at least one rib fixedly connecting the seal area to the dome area;

positioned the fluid dispensing valve being between the top and bottom retainers such that the interior dome surface is adjacent the bottom retainer, the dome perimeter is adjacent the top retainer, and the seal perimeter contacts the interior conduit surface to seal the conduit; and mounting the dispensing closure onto the container over the opening such that the conduit communicates with the container opening.

9. The method of claim 8 further comprising the steps of:

filling the container with the fluid;

inverting the container such that the fluid passes through the bottom aperture to contact the interior dome surface, the fluid dispensing valve functioning to seal the conduit; and squeezing the container, thereby compressing the volume of the container and increasing the pressure of the fluid against the interior dome surface, causing the resilient dome area to deform and, through the at least one rib, interrupt the sealed relationship of the seal perimeter with the conduit, thus allowing the fluid to flow through the conduit and out of the container.

10. The method of claim 9 further comprising the step of:

reducing the pressure within the container, causing the seal area between the at least one rib to flex inwards and create a plurality of venting flow paths.

11. The method of claim 8 wherein the seal area extends outwardly and downwardly from the dome perimeter such that fluid pressure on an exterior seal surface of the seal area causes the seal area to collapse between the at least one rib to create at least one venting flow path.

12. The method of claim 8 wherein the at least one rib includes three ribs equally spaced around the dome perimeter.

13. The method of claim 8 wherein the bottom retainer is a disk having a support ring that is upwardly extending from and co-axially aligned with a top surface of the disk, the support ring having a plurality of notches.

* * * * *